US009552805B2

(12) United States Patent
Lu et al.

(10) Patent No.: US 9,552,805 B2
(45) Date of Patent: Jan. 24, 2017

(54) SYSTEMS AND METHODS FOR PERFORMANCE AND STABILITY CONTROL FOR FEEDBACK ADAPTIVE NOISE CANCELLATION

(71) Applicant: Cirrus Logic, Inc., Austin, TX (US)

(72) Inventors: Yang Lu, Cedar Park, TX (US); Dayong Zhou, Austin, TX (US); Antonio J. Miller, Austin, TX (US); Ning Li, Cedar Park, TX (US)

(73) Assignee: Cirrus Logic, Inc., Austin, TX (US)

( * ) Notice: Subject to any disclaimer, the term of this patent is extended or adjusted under 35 U.S.C. 154(b) by 35 days.

(21) Appl. No.: 14/577,519

(22) Filed: Dec. 19, 2014

(65) Prior Publication Data

US 2016/0180830 A1 Jun. 23, 2016

(51) Int. Cl.
*G10K 11/178* (2006.01)
*H04R 1/10* (2006.01)

(52) U.S. Cl.
CPC ..... *G10K 11/178* (2013.01); *G10K 11/1784* (2013.01); *H04R 1/1083* (2013.01); *G10K 2210/1081* (2013.01); *G10K 2210/3056* (2013.01); *G10K 2210/503* (2013.01); *G10K 2210/506* (2013.01); *H04R 2460/01* (2013.01)

(58) Field of Classification Search
None
See application file for complete search history.

(56) References Cited

U.S. PATENT DOCUMENTS 5,117,401 A 5/1992 Feintuch
5,251,263 A 10/1993 Andrea et al.
5,278,913 A 1/1994 Delfosse et al.
(Continued)

FOREIGN PATENT DOCUMENTS

DE 102011013343 A1 9/2012
EP 0412902 A2 2/1991
(Continued)

OTHER PUBLICATIONS

English machine translation of JP 2006-217542 A (Okumura, Hiroshi; Howling Suppression Device and Loudspeaker; published Aug. 2006).*
(Continued)

*Primary Examiner* — Mark Fischer
(74) *Attorney, Agent, or Firm* — Jackson Walker L.L.P.

(57) ABSTRACT

A method for cancelling ambient audio sounds in the proximity of a transducer may include receiving an error microphone signal indicative of the output of the transducer and ambient audio sounds at the transducer. The method may also include generating an anti-noise signal for countering the effects of ambient audio sounds at an acoustic output of the transducer, wherein generating the anti-noise signal comprises applying a feedback filter having a response that generates a feedback anti-noise signal based on the error microphone signal and applying a variable gain element in series with the feedback filter. The method may further include monitoring whether an ambient audio event is occurring that could cause the feedback filter to generate an undesirable component in the anti-noise signal and controlling the gain of the variable gain element to reduce the undesirable component.

18 Claims, 9 Drawing Sheets

(56) References Cited

U.S. PATENT DOCUMENTS 5,321,759 A 6/1994 Yuan
5,337,365 A 8/1994 Hamabe et al.
5,359,662 A 10/1994 Yuan et al.
5,377,276 A 12/1994 Terai et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,559,893 A 9/1996 Krokstad
5,586,190 A 12/1996 Trantow et al.
5,640,450 A 6/1997 Watanabe
5,668,747 A 9/1997 Ohashi
5,696,831 A 12/1997 Inanaga
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,317,501 B1 11/2001 Matsuo
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,406,179 B2 7/2008 Ryan
7,466,838 B1 12/2008 Moseley
7,555,081 B2 6/2009 Keele, Jr.
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,155,334 B2 4/2012 Joho et al.
8,249,262 B2 8/2012 Chua et al.
8,290,537 B2 10/2012 Lee et al.
8,325,934 B2 12/2012 Kuo
8,363,856 B2 1/2013 Lesso
8,374,358 B2 2/2013 Buck et al.
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,539,012 B2 9/2013 Clark
8,804,974 B1 8/2014 Melanson
8,848,936 B2 9/2014 Kwatra et al.
8,907,829 B1 12/2014 Naderi
8,908,877 B2 12/2014 Abdollahzadeh Milani et al.
8,909,524 B2 12/2014 Stoltz et al.
8,942,976 B2 1/2015 Li et al.
8,948,407 B2 2/2015 Alderson et al.
8,948,410 B2 2/2015 Van Leest
8,958,571 B2 2/2015 Kwatra et al.
8,977,545 B2 3/2015 Zeng et al.
9,020,160 B2 4/2015 Gauger, Jr.
9,066,176 B2 6/2015 Hendrix et al.
9,082,391 B2 7/2015 Yermeche et al.
9,094,744 B1 7/2015 Lu et al.
9,106,989 B2 8/2015 Li et al.
9,107,010 B2 8/2015 Abdollahzadeh Milani et al.
9,264,808 B2 2/2016 Zhou et al.
9,294,836 B2 3/2016 Zhou et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0001450 A1 1/2004 He et al.
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0176955 A1 9/2004 Farinelli, Jr.
2004/0196992 A1* 10/2004 Ryan ..... H04R 1/10 381/312
2004/0202333 A1 10/2004 Czermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0018460 A1 1/2006 McCree
2006/0035593 A1 2/2006 Leeds
2006/0055910 A1 3/2006 Lee
2006/0069556 A1 3/2006 Nadjar et al.
2006/0109941 A1 5/2006 Keele, Jr.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0166002 A1 7/2008 Amsel
2008/0177532 A1 7/2008 Greiss et al.
2008/0181422 A1 7/2008 Christoph
2008/0226098 A1 9/2008 Haulick et al.
2008/0240413 A1 10/2008 Mohammad et al.
2008/0240455 A1 10/2008 Inoue et al.
2008/0240457 A1 10/2008 Innoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1 5/2009 Taenzer
2009/0175461 A1 7/2009 Nakamura et al.
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.

(56) References Cited

U.S. PATENT DOCUMENTS

2010/0098263 A1 4/2010 Pan et al.
2010/0098265 A1 4/2010 Pan et al.
2010/0124336 A1 5/2010 Shridhar et al.
2010/0124337 A1 5/2010 Shridhar et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0183175 A1 7/2010 Chen et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Joho et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0310087 A1 12/2010 Ishida
2010/0316225 A1 12/2010 Saito et al.
2010/0322430 A1 12/2010 Isberg
2011/0002468 A1 1/2011 Tanghe
2011/0007907 A1 1/2011 Park et al.
2011/0026724 A1 2/2011 Doclo
2011/0096933 A1 4/2011 Eastty
2011/0099010 A1 4/2011 Zhang
2011/0106533 A1 5/2011 Yu
2011/0116643 A1 5/2011 Tiscareno
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0084080 A1 4/2012 Konchitsky et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1 7/2012 Oh et al.
2012/0185524 A1 7/2012 Clark
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0083939 A1 4/2013 Fellers et al.
2013/0156238 A1 6/2013 Birch et al.
2013/0222516 A1 8/2013 Do et al.
2013/0243198 A1 9/2013 Van Rumpt
2013/0243225 A1 9/2013 Yokota
2013/0259251 A1 10/2013 Bakalos
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301846 A1 11/2013 Alderson et al.
2013/0301847 A1 11/2013 Alderson et al.
2013/0301848 A1 11/2013 Zhou et al.
2013/0301849 A1 11/2013 Alderson
2013/0315403 A1 11/2013 Samuelsson
2013/0343556 A1 12/2013 Bright
2013/0343571 A1 12/2013 Rayala et al.
2014/0036127 A1 2/2014 Pong et al.
2014/0044275 A1 2/2014 Goldstein et al.
2014/0050332 A1 2/2014 Nielsen et al.
2014/0051483 A1 2/2014 Schoerkmaier
2014/0072134 A1 3/2014 Po et al.
2014/0072135 A1 3/2014 Bajic et al.
2014/0086425 A1 3/2014 Jensen et al.
2014/0126735 A1 5/2014 Gauger, Jr.
2014/0169579 A1 6/2014 Azmi
2014/0177851 A1 6/2014 Kitazawa et al.
2014/0177890 A1 6/2014 Hojlund et al.
2014/0211953 A1 7/2014 Alderson et al.
2014/0226827 A1 8/2014 Abdollahzadeh Milani et al.
2014/0270222 A1 9/2014 Hendrix et al.
2014/0270223 A1 9/2014 Li et al.
2014/0270224 A1 9/2014 Zhou et al.
2014/0294182 A1 10/2014 Axelsson
2014/0307887 A1 10/2014 Alderson et al.
2014/0307888 A1 10/2014 Alderson et al.
2014/0307890 A1 10/2014 Zhou et al.
2014/0307899 A1 10/2014 Hendrix et al.
2014/0314244 A1 10/2014 Yong et al.
2014/0314246 A1 10/2014 Hellmann
2014/0314247 A1 10/2014 Zhang
2014/0341388 A1 11/2014 Goldstein
2014/0369517 A1 12/2014 Zhou et al.
2015/0078572 A1 3/2015 Abdollahzadeh Milani et al.
2015/0092953 A1 4/2015 Abdollahzadeh Milani et al.
2015/0104032 A1 4/2015 Kwatra et al.
2015/0161980 A1 6/2015 Alderson et al.
2015/0161981 A1 6/2015 Kwatra
2015/0163592 A1 6/2015 Alderson
2015/0256660 A1 9/2015 Kaller et al.
2015/0256953 A1 9/2015 Kwatra et al.
2015/0269926 A1 9/2015 Alderson et al.
2015/0365761 A1 12/2015 Alderson
2016/0180830 A1 6/2016 Lu et al.

FOREIGN PATENT DOCUMENTS

EP 0756407 A2 1/1997
EP 0898266 A2 2/1999
EP 1691577 A2 8/2006
EP 1880699 A2 1/2008
EP 1947642 A1 7/2008
EP 2133866 A1 12/2009
EP 2237573 A1 10/2010
EP 2216774 A1 8/2011
EP 2395500 A1 12/2011
EP 2395501 A1 12/2011
EP 2551845 A1 1/2013
EP 2583074 A1 4/2013
EP 2984648 A2 2/2016
EP 2987160 A1 2/2016
EP 2987162 A1 2/2016
EP 2987337 A1 2/2016
GB 2401744 A 11/2004
GB 2436657 A 10/2007
GB 2455821 A 6/2009
GB 2455824 A 6/2009

(56) References Cited

FOREIGN PATENT DOCUMENTS

| | | | | |
|---|---|---|---|---|
| GB | 2455828 | A | | 6/2009 |
| GB | 2484722 | A | | 4/2012 |
| JP | 06006246 | | | 1/1994 |
| JP | H06186985 | A | | 7/1994 |
| JP | H06232755 | | | 8/1994 |
| JP | 07098592 | | | 4/1995 |
| JP | 07325588 | A | | 12/1995 |
| JP | H11305783 | A | | 11/1999 |
| JP | 2000089770 | | | 3/2000 |
| JP | 2002010355 | | | 1/2002 |
| JP | 2004007107 | | | 1/2004 |
| JP | 2006217542 | A | * | 8/2006 |
| JP | 2007060644 | | | 3/2007 |
| JP | 2008015046 | A | | 1/2008 |
| JP | 2010277025 | | | 12/2010 |
| JP | 2011061449 | | | 3/2011 |
| WO | 9911045 | | | 3/1999 |
| WO | 03015074 | A1 | | 2/2003 |
| WO | 03015275 | A1 | | 2/2003 |
| WO | 2004009007 | A1 | | 1/2004 |
| WO | 2004017303 | A1 | | 2/2004 |
| WO | 2006125061 | A1 | | 11/2006 |
| WO | 2006128768 | A1 | | 12/2006 |
| WO | 2007007916 | A1 | | 1/2007 |
| WO | 2007011337 | A1 | | 1/2007 |
| WO | 2007110807 | A2 | | 10/2007 |
| WO | 2007113487 | A1 | | 11/2007 |
| WO | 2009041012 | A1 | | 4/2009 |
| WO | 2009110087 | A1 | | 9/2009 |
| WO | 2010117714 | A1 | | 10/2010 |
| WO | 2011035061 | A1 | | 3/2011 |
| WO | 2012107561 | A1 | | 8/2012 |
| WO | 2012119808 | A2 | | 9/2012 |
| WO | 2012134874 | A1 | | 10/2012 |
| WO | 2012166273 | A2 | | 12/2012 |
| WO | 2012166388 | A2 | | 12/2012 |
| WO | 2013106370 | A1 | | 7/2013 |
| WO | 2014158475 | A1 | | 10/2014 |
| WO | 2014168685 | A2 | | 10/2014 |
| WO | 2014172005 | A1 | | 10/2014 |
| WO | 2014172006 | A1 | | 10/2014 |
| WO | 2014172010 | A1 | | 10/2014 |
| WO | 2014172019 | A1 | | 10/2014 |
| WO | 2014172021 | A1 | | 10/2014 |
| WO | 2014200787 | A1 | | 12/2014 |
| WO | 2015038255 | A1 | | 3/2015 |
| WO | 2015088639 | A | | 6/2015 |
| WO | 2015088651 | A1 | | 6/2015 |
| WO | 2015088653 | A1 | | 6/2015 |
| WO | 2015134225 | A1 | | 9/2015 |
| WO | 2015191691 | A1 | | 12/2015 |
| WO | 2016100602 | A1 | | 6/2016 |

OTHER PUBLICATIONS

International Patent Application No. PCT/US2015/017124, International Search Report and Written Opinion, Jul. 13, 2015, 19 pages.

International Patent Application No. PCT/US2015/035073, International Search Report and Written Opinion, Oct. 8, 2015, 11 pages.

Parkins, et al., Narrowband and broadband active control in an enclosure using the acoustic energy density, J. Acoust. Soc. Am. Jul. 2000, pp. 192-203, vol. 108, issue 1, U.S.

International Patent Application No. PCT/US2015/022113, International Search Report and Written Opinion, Jul. 23, 2015, 13 pages.

Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.

International Patent Application No. PCT/US2014/017112, International Search Report and Written Opinion, May 8, 2015, 22 pages.

International Patent Application No. PCT/US2014/049600, International Search Report and Written Opinion, Jan. 14, 2015, 12 pages.

International Patent Application No. PCT/US2014/061753, International Search Report and Written Opinion, Feb. 9, 2015, 8 pages.

International Patent Application No. PCT/US2014/061548, International Search Report and Written Opinion, Feb. 12, 2015, 13 pages.

International Patent Application No. PCT/US2014/060277, International Search Report and Written Opinion, Mar. 9, 2015, 11 pages.

Kou, Sen and Tsai, Jianming, Residual noise shaping technique for active noise control systems, J. Acoust. Soc. Am. 95 (3), Mar. 1994, pp. 1665-1668.

Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.

Toochinda, et al., "A Single-Input Two-Output Feedback Formulation for ANC Problems," Proceedings of the 2001 American Control Conference, Jun. 2001, pp. 923-928, vol. 2, Arlington, VA.

Kuo, et al., "Active Noise Control: A Tutorial Review," Proceedings of the IEEE, Jun. 1999, pp. 943-973, vol. 87, No. 6, IEEE Press, Piscataway, NJ.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.

Mali, Dilip, "Comparison of DC Offset Effects on LMB Algorithm and its Derivatives," International Journal of Recent Trends in Engineering, May 2009, pp. 323-328, vol. 1, No. 1, Academy Publisher.

Kates, James M., "Principles of Digital Dynamic Range Compression," Trends in Amplification, Spring 2005, pp. 45-76, vol. 9, No. 2, Sage Publications.

Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.

Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.

Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.

Davari, et al., "A New Online Secondary Path Modeling Method for Feedforward Active Noise Control Systems," IEEE International Conference on Industrial Technology, Apr. 21-24, 2008, pp. 1-6, Chengdu, China.

Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.

Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.

Booji, P.S., Berkhoff, A.P., Virtual sensors for local, three dimensional, broadband multiple-channel active noise control and the effects on the quiet zones, Proceedings of ISMA2010 including USD2010, pp. 151-166.

Lopez-Caudana, Edgar Omar, Active Noise Cancellation: The Unwanted Signal and The Hybrid Solution, Adaptive Filtering Applications, Dr. Lino Garcia, ISBN: 978-953-307-306-4, InTech.

D. Senderowicz et al., "Low-Voltage Double-Sampled Delta-Sigma Converters," IEEE J. Solid-State Circuits, vol. 32,, No. 12, pp. 1907-1919, Dec. 1997, 13 pages.

Hurst, P.J. and Dyer, K.C., "An improved double sampling scheme for switched-capacitor delta-sigma modulators," IEEE Int. Symp. Circuits Systems, May 1992, vol. 3, pp. 1179-1182, 4 pages.

(56) References Cited

OTHER PUBLICATIONS

Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.
Ryan, et al., "Optimum near-field performance of microphone arrays subject to a far-field beampattern constraint", 2248 J. Acoust. Soc. Am. 108, Nov. 2000.
Cohen, et al., "Noise Estimation by Minima Controlled Recursive Averaging for Robust Speech Enhancement", IEEE Signal Processing Letters, vol. 9, No. 1, Jan. 2002.
Martin, "Noise Power Spectral Density Estimation Based on Optimal Smoothing and Minimum Statistics", IEEE Trans. on Speech and Audio Processing, col. 9, No. 5, Jul. 2001.
Martin, "Spectral Subtraction Based on Minimum Statistics", Proc. 7th EUSIPCO '94, Edinburgh, U.K., Sep. 13-16, 1994, pp. 1182-1195.
Cohen, "Noise Spectrum Estimation in Adverse Environments: Improved Minima Controlled Recursive Averaging", IEEE Trans. on Speech & Audio Proc., vol. 11, Issue 5, Sep. 2003.
Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
International Patent Application No. PCT/US2014/017096, International Search Report and Written Opinion, May 27, 2014, 11 pages.
Jin, et al., "A simultaneous equation method-based online secondary path modeling algorithm for active noise control", Journal of Sound and Vibration, Apr. 25, 2007, pp. 455-474, vol. 303, No. 3-5, London, GB.
Erkelens et al., "Tracking of Nonstationary Noise Based on Data-Driven Recursive Noise Power Estimation", IEEE Transactions on Audio Speech, and Language Processing, vol. 16, No. 6, Aug. 2008.
Rao et al., "A Novel Two Stage Single Channle Speech Enhancement Technique", India Conference (INDICON) 2011 Annual IEEE, IEEE, Dec. 15, 2011.
Rangachari et al., "A noise-estimation algorithm for highly non-stationary environments" Speech Communication, Elsevier Science Publishers, vol. 48, No. 2, Feb. 1, 2006.
International Search Report and Written Opinion of the International Searching Authority, International Patent Application No. PCT/US2014/017343, mailed Aug. 8, 2014, 22 pages.
International Search Report and Written Opinion of the International Searching Authority, International Patent Application No. PCT/US2014/018027, mailed Sep. 4, 2014, 14 pages.
International Search Report and Written Opinion of the International Searching Authority, International Patent Application No. PCT/US2014/017374, mailed Sep. 8, 2014, 13 pages.
International Search Report and Written Opinion of the International Searching Authority, International Patent Application No. PCT/US2014/019395, mailed Sep. 9, 2014, 12 pages.
International Search Report and Written Opinion of the International Searching Authority, International Patent Application No. PCT/US2014/019469, mailed Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, Oct. 18, 2014, 12 pages.
International Patent Application No. PCT/US2013/049407, International Search Report and Written Opinion, Jun. 18, 2014, 13 pages.
Combined Search and Examination Report, Application No. GB1512832.5, mailed Jan. 28, 2016, 7 pages.
International Patent Application No. PCT/US2015/066260, International Search Report and Written Opinion, Apr. 21, 2016, 13 pages.
English machine translation of JP 2006-217542 A (Okumura, Hiroshi; Howling Suppression Device and Loudspeaker, published Aug. 2006).
Combined Search and Examination Report, Application No. GB1519000.2, mailed Apr. 21, 2016, 5 pages.

* cited by examiner

SYSTEMS AND METHODS FOR PERFORMANCE AND STABILITY CONTROL FOR FEEDBACK ADAPTIVE NOISE CANCELLATION

FIELD OF DISCLOSURE

The present disclosure relates in general to adaptive noise cancellation in connection with an acoustic transducer, and more particularly, performance and stability control for feedback active noise cancellation.

BACKGROUND

Wireless telephones, such as mobile/cellular telephones, cordless telephones, and other consumer audio devices, such as mp3 players, are in widespread use. Performance of such devices with respect to intelligibility can be improved by providing noise cancelling using a microphone to measure ambient acoustic events and then using signal processing to insert an anti-noise signal into the output of the device to cancel the ambient acoustic events.

In an adaptive noise cancellation system, it is often desirable for the system to be fully adaptive such that a maximum noise cancellation effect is provided to a user at all times. Adaptive noise cancellation systems often use a fixed feedback controller due to low cost, simplicity, wide-band noise cancellation, and other advantages. However, existing feedback noise cancellation systems have disadvantages. For example, feedback noise cancellation cancels at least a portion of a source audio signal which may cause degraded audio performance of a device. In order to maintain reasonable audio performance, the gain of the feedback controller may need to be reduced, and thus noise cancellation performance is compromised. In addition, due to varying conditions (e.g., different shapes of user's ears, different ways user's wear headphones, etc.), noise cancellation strength may differ from user to user. Furthermore, a feedback controller may become unstable if a secondary path of a device utilizing ANC changes.

SUMMARY

In accordance with the teachings of the present disclosure, certain disadvantages and problems associated with existing approaches to feedback adaptive noise cancellation may be reduced or eliminated.

In accordance with embodiments of the present disclosure, an integrated circuit for implementing at least a portion of a personal audio device may include an output, an error microphone input, and a processing circuit. The output may be configured to provide an output signal to a transducer including both a source audio signal for playback to a listener and an anti-noise signal for countering the effect of ambient audio sounds in an acoustic output of the transducer. The error microphone input may be configured to receive an error microphone signal indicative of the output of the transducer and the ambient audio sounds at the transducer. The processing circuit may implement a feedback path and an event detection and oversight control. The feedback path may include a feedback filter having a response that generates a feedback anti-noise signal based on the error microphone signal and a variable gain element in series with the feedback filter. The event detection and oversight control may detect that an ambient audio event is occurring that could cause the feedback filter to generate an undesirable component in the anti-noise signal and control the gain of the variable gain element to reduce the undesirable component.

In accordance with these and other embodiments of the present disclosure, an integrated circuit for implementing at least a portion of a personal audio device may include an output, an error microphone input, and a processing circuit. The output may be configured to provide an output signal to a transducer including both a source audio signal for playback to a listener and an anti-noise signal for countering the effect of ambient audio sounds in an acoustic output of the transducer. The error microphone input may be configured to receive an error microphone signal indicative of the output of the transducer and the ambient audio sounds at the transducer. The processing circuit may implement a feedback path comprising a feedback filter having a response that generates a feedback anti-noise signal based on the error microphone signal and an adaptive notch filter in the feedback path in series with the feedback filter in order to reduce the response of the feedback filter in certain frequency ranges.

In accordance with these and other embodiments of the present disclosure, a method for cancelling ambient audio sounds in the proximity of a transducer may include receiving an error microphone signal indicative of the output of the transducer and ambient audio sounds at the transducer. The method may also include generating an anti-noise signal for countering the effects of ambient audio sounds at an acoustic output of the transducer, wherein generating the anti-noise signal comprises applying a feedback filter having a response that generates a feedback anti-noise signal based on the error microphone signal and applying a variable gain element in series with the feedback filter. The method may further include monitoring whether an ambient audio event is occurring that could cause the feedback filter to generate an undesirable component in the anti-noise signal and controlling the gain of the variable gain element to reduce the undesirable component. The method may additionally include combining the anti-noise signal with a source audio signal to generate an audio signal provided to the transducer.

In accordance with these and other embodiments of the present disclosure, a method for cancelling ambient audio sounds in the proximity of a transducer may include receiving an error microphone signal indicative of the output of the transducer and ambient audio sounds at the transducer. The method may also include generating an anti-noise signal for countering the effects of ambient audio sounds at an acoustic output of the transducer, wherein generating the anti-noise signal comprises applying a feedback filter having a response that generates a feedback anti-noise signal based on the error microphone signal and applying an adaptive notch filter in series with the feedback filter in order to reduce the response of the feedback filter in certain frequency ranges. The method may further include combining the anti-noise signal with a source audio signal to generate an audio signal provided to the transducer.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise cancelling techniques and circuits that can be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment and an error microphone may be included for controlling the adaptation of the anti-noise signal to cancel the ambient audio sounds and for correcting for the electro-acoustic path from the output of the processing circuit through the transducer.

Figure 1A:
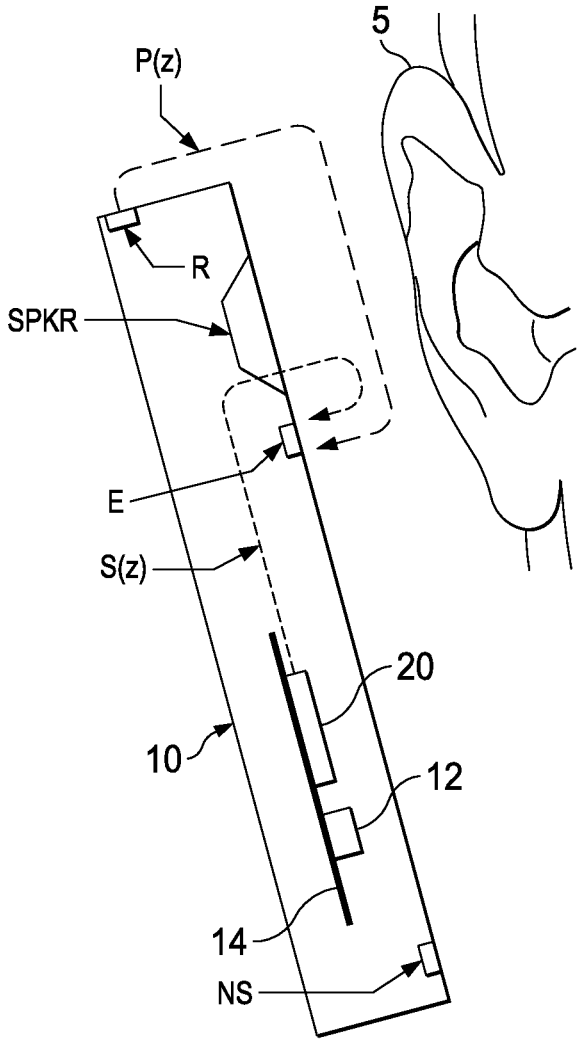
FIG. 1A is an illustration of an example wireless mobile telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of a device in which techniques in accordance with embodiments of this disclosure may be employed, but it is understood that not all of the elements or configurations embodied in illustrated wireless telephone 10, or in the circuits depicted in subsequent illustrations, are required in order to practice the inventions recited in the claims. Wireless telephone 10 may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In other embodiments, additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone.

Figure 1B:
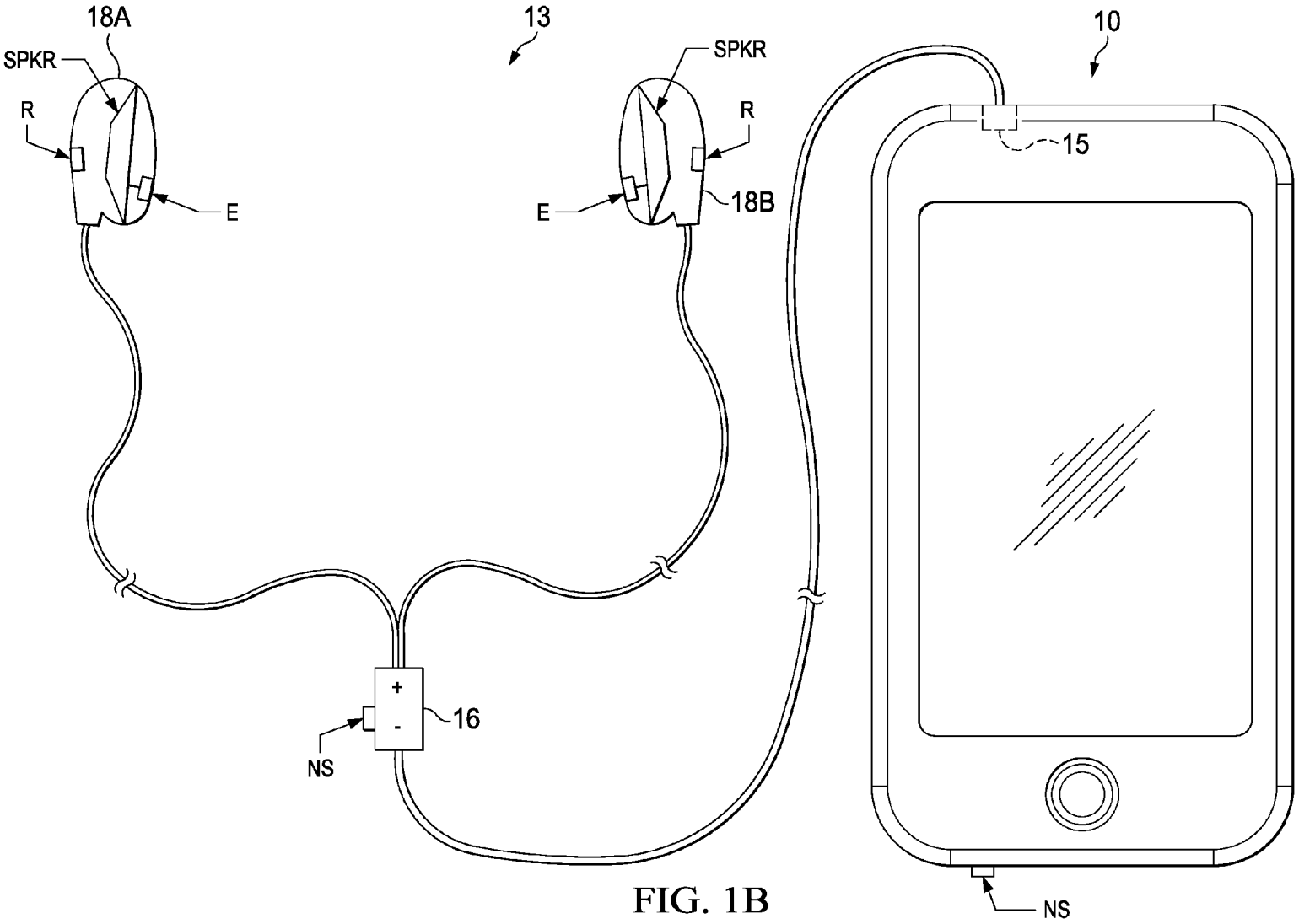
FIG. 1B is an illustration of an example wireless mobile telephone with a headphone assembly coupled thereto, in accordance with embodiments of the present disclosure.

Referring now to FIG. 1B, wireless telephone 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. In some embodiments, headphone assembly 13 may comprise a wireless headphone assembly, in which case all or some portions of CODEC IC 20 may be present in headphone assembly 13, and headphone assembly 13 may include a wireless communication interface (e.g., BLUETOOTH) in order to communicate between headphone assembly 13 and wireless telephone 10.

As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone" may refer to intra-concha earphones, supra-concha earphones, and supra-aural earphones.

Combox 16 or another portion of headphone assembly 13 may have a near-speech microphone NS to capture near-end speech in addition to or in lieu of near-speech microphone NS of wireless telephone 10. In addition, each headphone 18A, 18B may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R and error microphone E of each headphone and near-speech microphone NS, and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2:
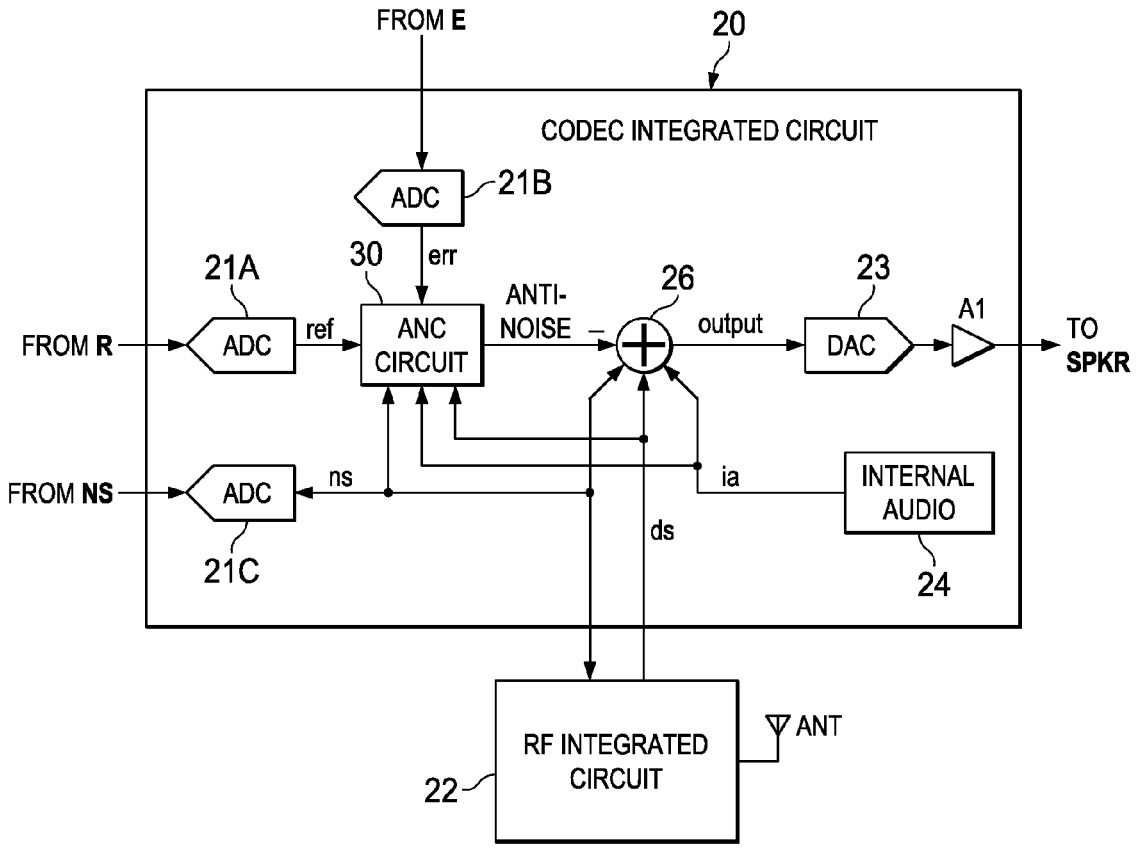
FIG. 2 is a block diagram of selected circuits within the wireless mobile telephone depicted in FIG. 1, in accordance with embodiments of the present disclosure.

Referring now to FIG. 2, selected circuits within wireless telephone 10 are shown in a block diagram, which in other embodiments may be placed in whole or in part in other locations such as one or more headphones or earbuds. CODEC IC 20 may include an analog-to-digital converter (ADC) 21A for receiving the reference microphone signal from microphone R and generating a digital representation ref of the reference microphone signal, an ADC 21B for receiving the error microphone signal from error microphone E and generating a digital representation err of the error microphone signal, and an ADC 21C for receiving the near speech microphone signal from near speech microphone NS and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3A:
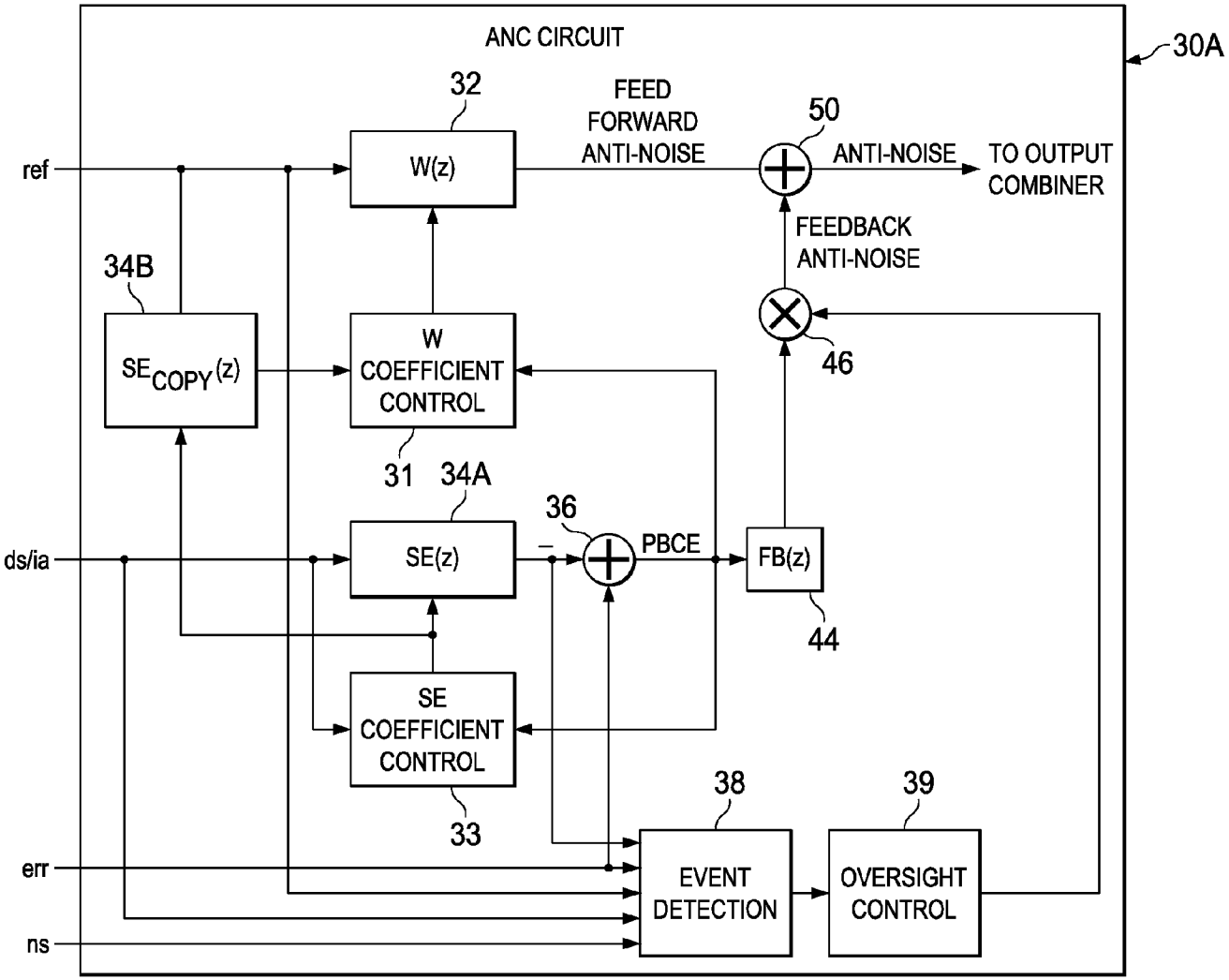
FIG. 3A is a block diagram depicting selected signal processing circuits and functional blocks within an example adaptive noise cancelling (ANC) circuit of a coder-decoder (CODEC) integrated circuit of FIG. 2 which uses feedforward filtering to generate an anti-noise signal, in accordance with embodiments of the present disclosure.

Referring now to FIG. 3A, details of ANC circuit 30A which may be used to implement ANC circuit 30 are shown in accordance with embodiments of the present disclosure. Adaptive filter 32 may receive reference microphone signal ref and under ideal circumstances, may adapt its transfer function W(z) to be P(z)/S(z) to generate a feedforward anti-noise component of the anti-noise signal, which may be combined by combiner 50 with a feedback anti-noise component of the anti-noise signal (described in greater detail below) to generate an anti-noise signal which in turn may be provided to an output combiner that combines the anti-noise signal with the source audio signal to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}(z)$, and minimizing the ambient audio sounds in the error microphone signal, adaptive filter 32 may adapt to the desired response of P(z)/S(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{COPY}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err. However, by transforming that inverted copy of downlink audio signal ds and/or internal audio signal ia with the estimate of the response of path S(z), the downlink audio and/or internal audio that is removed from error microphone signal err should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia and error microphone signal err after removal of the above-described filtered downlink audio signal ds and/or internal audio signal ia, that has been filtered by adaptive filter 34A to represent the expected downlink audio delivered to error microphone E, and which is removed from the output of adaptive filter 34A by a combiner 36 to generate a playback-corrected error, shown as PBCE in FIG. 3A. SE coefficient control block 33 may correlate the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

As depicted in FIG. 3A, ANC circuit 30A may also comprise feedback filter 44. Feedback filter 44 may receive the playback corrected error signal PBCE and may apply a response FB(z) to generate a feedback signal based on the playback corrected error. Also as depicted in FIG. 3A, a path of the feedback anti-noise component may have a programmable gain element 46 in series with feedback filter 44 such that the product of response FB(z) and a gain of programmable gain element 46 is applied to playback corrected error signal PBCE in order to generate the feedback anti-noise component of the anti-noise signal. The feedback anti-noise component of the anti-noise signal may be combined by combiner 50 with the feedforward anti-noise component of the anti-noise signal to generate the anti-noise signal which in turn may be provided to an output combiner that combines the anti-noise signal with the source audio signal to be reproduced by the transducer, as exemplified by combiner 26 of FIG. 2.

In operation, an increased gain of programmable gain element 46 may cause increased noise cancellation of the feedback anti-noise component, and a decreased gain may cause reduced noise cancellation of the feedback anti-noise component. In some embodiments, as described in greater detail below, oversight control 39, in conjunction with event detection block 38, may control the gain of programmable gain element 46 in response to detection of an ambient audio event that could cause feedback filter 44 to generate an undesirable component in the anti-noise signal in order to reduce the undesirable component.

Although feedback filter 44 and gain element 46 are shown as separate components of ANC circuit 30, in some embodiments some structure and/or function of feedback filter 44 and gain element 46 may be combined. For example, in some of such embodiments, an effective gain of feedback filter 44 may be varied via control of one or more filter coefficients of feedback filter 44.

Event detection 38 and oversight control block 39 may perform various actions in in response to various events, as described in greater detail herein, including, without limitation, controlling the gain of programmable gain element 46. In some embodiments, event detection 38 and oversight control block 39 may be similar in structure and/or functionality as the event detection and oversight control logic described in U.S. patent application Ser. No. 13/309,494 by Jon D. Hendrix et al., filed Dec. 1, 2011, entitled "Oversight Control of an Adaptive Noise Canceler in a Personal Audio Device," and assigned to the applicant of the present application.

Figure 4:
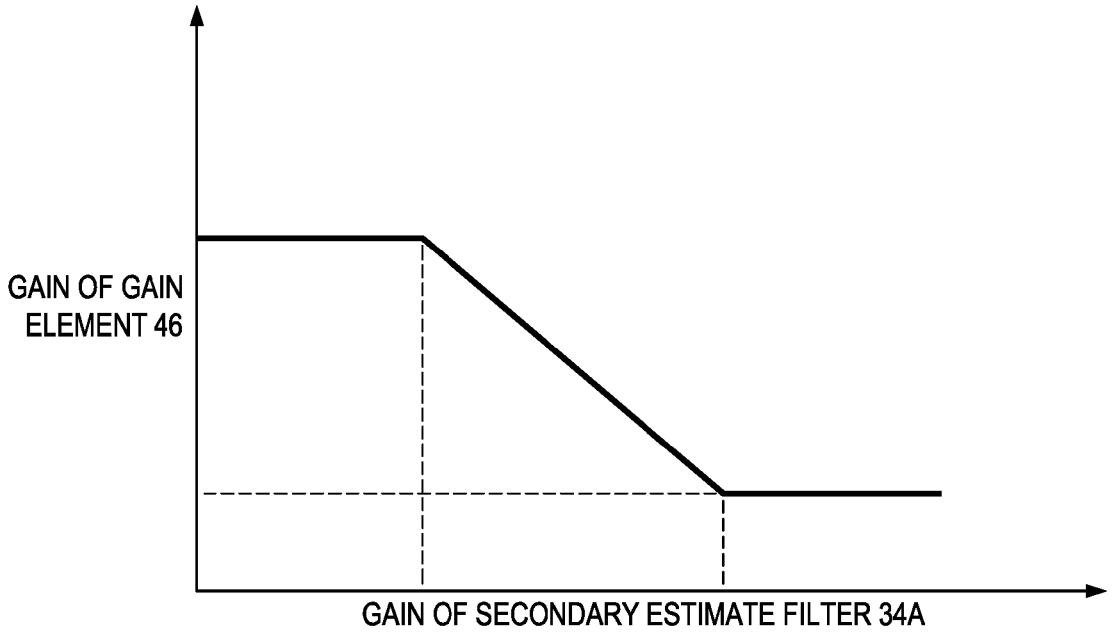
FIG. 4 illustrates a graph depicting an example gain calculated by an event detection and oversight control block as a function of a gain of a secondary estimate filter in accordance with embodiments of the present disclosure.

In some embodiments, event detection 38 and oversight control block 39 may monitor signals within ANC circuit 30A (e.g., source audio signal ds/ia and a signal output by secondary estimate filter 34A), in order to determine a gain of secondary estimate filter 34A and/or magnitude of the response SE(z) of secondary estimate filter 34A. Because secondary estimate filter 34A models the electroacoustic path to a user's ear, response SE(z) indicates how speaker SPKR is acoustically coupled to the user's ear. Thus, a magnitude or gain of response SE(z) at certain frequency bands may indicate how loose or tight a device (e.g., a headphone) is coupled to a user's ear. Because response SE(z) may be continuously trained by ANC circuit 30A, change in response SE(z), and thus the change in fitting of speaker SPKR to the user's ear, may be tracked over time, and the gain of the programmable feedback element 46 may be adjusted as a function of the change in response SE(z). FIG. 4 illustrates a graph depicting an example gain calculated by event detection 38 and oversight control block 39 as a function of a gain of secondary estimate filter 34A, in accordance with embodiments of the present disclosure. As shown in FIG. 4, the gain of gain element 46 may increase when a gain of secondary path estimate filter 34A decreases and may decrease when the gain of secondary path estimate filter 34A increases.

Figure 5:
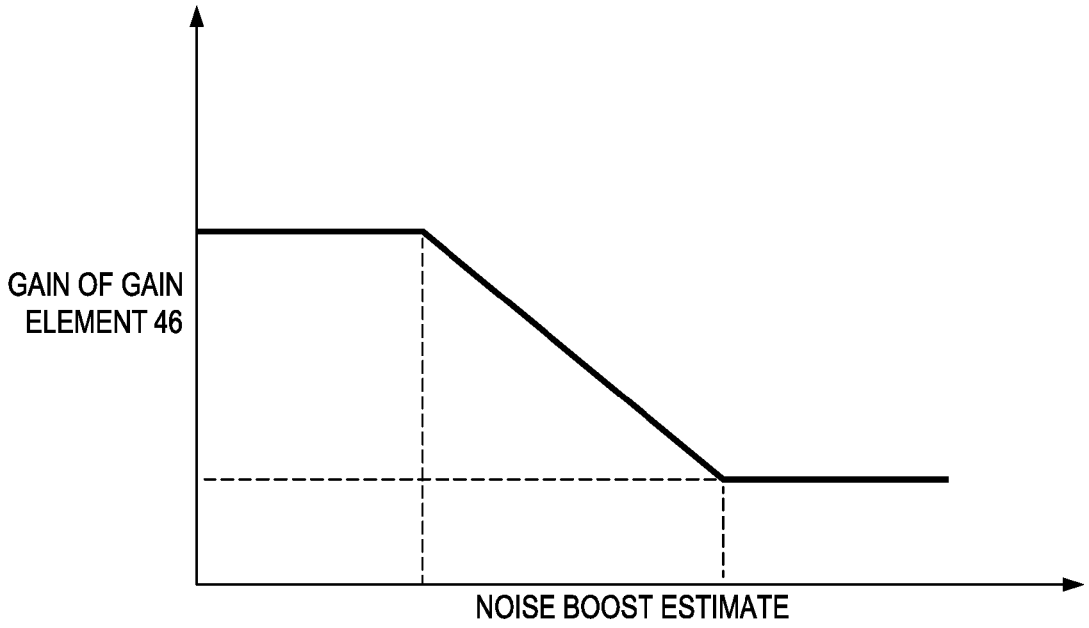
FIG. 5 illustrates a graph depicting an example gain calculated by an event detection and oversight control block as a function of a gain of a noise boost estimate, in accordance with embodiments of the present disclosure.

As another example, in these and other embodiments, event detection 38 and oversight control block 39 may monitor signals within ANC circuit 30A (e.g., playback corrected error PBCE and reference microphone signal ref) to determine a noise boost estimate of ANC circuit 30A. In general, when ANC circuit 30A is operating properly, error microphone E may typically sense less sound pressure than reference microphone R in the absence of a source audio signal. However, if the feedback loop comprising feedback filter 44 is unstable or does not perform as expected due to changes in the secondary path or because the secondary path is different than expected, error microphone E may sense higher sound pressure than reference microphone R. The amount of noise boost may be estimated by comparing the level of difference between or the ratio of playback corrected error PBCE and reference microphone signal ref, which may be performed in the time domain and/or frequency domain. Based on such noise boost estimate, event detection 38 and oversight control block 39 may control the gain of the programmable feedback element 46. FIG. 5 illustrates a graph depicting an example gain calculated by event detection 38 and oversight control block 39 as a function of a gain of the noise boost estimate, in accordance with embodiments of the present disclosure. As shown in FIG. 5, the gain of gain element 46 may increase when the noise boost estimate decreases and may decrease when the noise boost estimate increases. In some embodiments, event detection 38 and oversight control block 39 may vary gain of gain element 46 as a function of the noise boost estimate when information regarding the gain of secondary path estimate filter 34A is not available (e.g., when no training signal is available to adapt secondary path estimate filter 34A).

Figure 6:
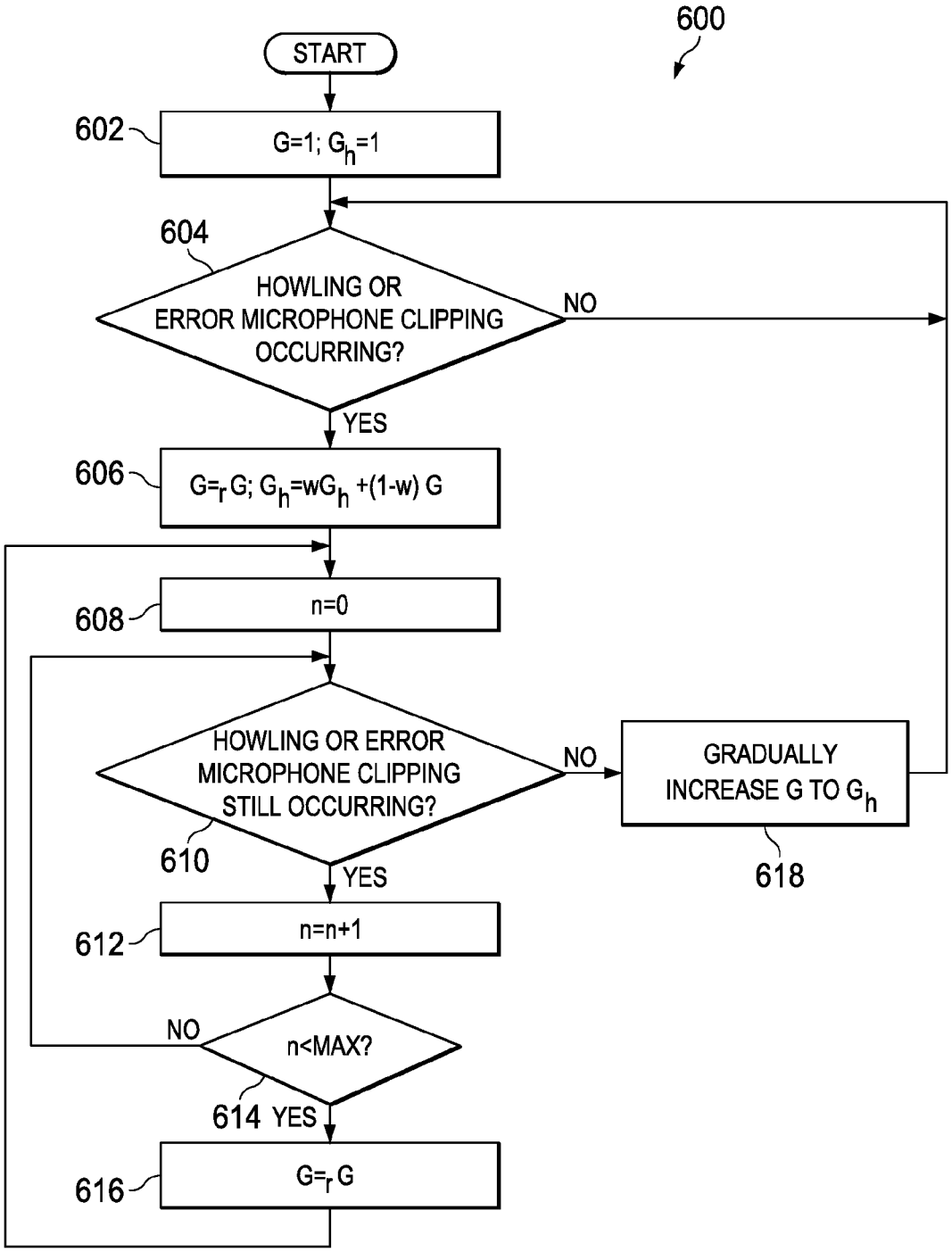
FIG. 6 is a flow chart of an example method for controlling gain of a programmable gain element in the presence of howling or error microphone clipping, in accordance with embodiments of the present disclosure.

As another example, in these and other embodiments, event detection 38 and oversight control block 39 may determine whether howling or error microphone clipping has occurred. Howling or error microphone clipping may occur when the ambient audio event is a signal due to positive feedback through reference microphone R due to alteration of coupling between speaker SPKR and the reference microphone R and/or when the ambient audio event is a signal due to positive feedback through error microphone E due to alteration of coupling between speaker SPKR and the error microphone E. When howling or error microphone clipping occurs, event detection 38 and oversight control block 39 may attenuate the gain of programmable gain element 46 until the howling or clipping is no longer present. In addition, when the howling or clipping is no longer present, event detection 38 and oversight control block 39 may restore the gain of programmable gain element 46 to a particular level. FIG. 6 sets forth a flow chart of an example method for controlling gain of programmable gain element 46 in the presence of howling or error microphone clipping, in accordance with embodiments of the present disclosure. According to some embodiments, method 600 begins at step 602. As noted above, teachings of the present disclosure are implemented in a variety of configurations of wireless telephone 10. As such, the preferred initialization point for method 600 and the order of the steps comprising method 600 may depend on the implementation chosen.

At step 602, oversight control block 39 may initialize variables. For example, oversight control block 39 may initialize a gain G for programmable gain element 46 to a value of 1. In addition, oversight control block 39 may initialize a post-howling maximum gain $G_h$ for programmable gain element 46 to 1.

At step 604, event detection block 38 may detect whether howling or error microphone clipping is occurring. If howling or error microphone clipping is occurring, method 600 may proceed to step 606. Otherwise, method 600 may remain at step 604 until howling or error microphone clipping is detected.

At step 606, oversight control block 39 may reduce gain G by a factor r, wherein r has a positive value less than 1. The value r may be a constant that defines a rate at which gain G is reduced each time step 606 is executed. The value of r may be predetermined by a manufacturer or other provider of wireless telephone 10 or an ANC circuit (e.g., ANC circuit 30A or 30C) or by a user of wireless telephone 10. The value r may be set in order to achieve one or more subjective goals, such as smoothness of transition of reduced gain G and the speed at which gain G is reduced. In addition, oversight control block 39 may set a value for the post-howling maximum gain $G_h$. For example, upon the occurrence of the howling event, oversight control block 39 may set the value of $G_h = wG_h + (1-w)G$, wherein w is a weighting factor that defines a middle ground of a new post-howling maximum gain $G_h$ between a present value of post-howling maximum gain $G_h$ and gain G. If w is set to less than 1, then after each howling event, the post-howling maximum gain $G_h$ is reduced, such that eventually, gain G will be set to a maximum level that is unlikely to lead to howling. The value of w may be predetermined by a manufacturer or other provider of wireless telephone 10 or an ANC circuit (e.g., ANC circuit 30A or 30C) or by a user of wireless telephone 10.

At step 608, oversight control block 39 may initialize a counter n to a value of 0.

At step 610, event detection block 38 may detect whether howling or error microphone clipping is still occurring. If howling or error microphone clipping is still occurring, method 600 may proceed to step 612. Otherwise, method 600 may proceed to step 618.

At step 612, oversight control block 39 may increment counter n. At step 614, oversight control block 39 may determine if counter n has reached its max value. If counter n has reached its max value, method 600 may proceed to step 616. Otherwise, method 600 may proceed again to step 610.

At step 616, in response to counter n reaching its maximum value, oversight control block 39 may again reduce gain G by factor r. After completion of step 616, method 600 may proceed again to step 608.

At step 618, oversight control block 39 may gradually increase gain G to post-howling maximum gain $G_h$. After completion of step 618, method 600 may return again to step 604.

Although FIG. 6 discloses a particular number of steps to be taken with respect to method 600, method 600 may be executed with greater or fewer steps than those depicted in FIG. 6. In addition, although FIG. 6 discloses a certain order of steps to be taken with respect to method 600, the steps comprising method 600 may be completed in any suitable order.

Method 600 may be implemented using wireless telephone 10 or any other system operable to implement method 600. In certain embodiments, method 600 may be implemented partially or fully in software and/or firmware embodied in computer-readable media and executable by a controller.

As a result of method 600, when howling or error microphone clipping is present, the gain G may be periodically reduced (e.g., by factor r for each reduction). After the howling or microphone clipping is no longer present, the gain G may then be restored to a maximum level (e.g., post-howling maximum gain $G_h$).

Figure 3B:
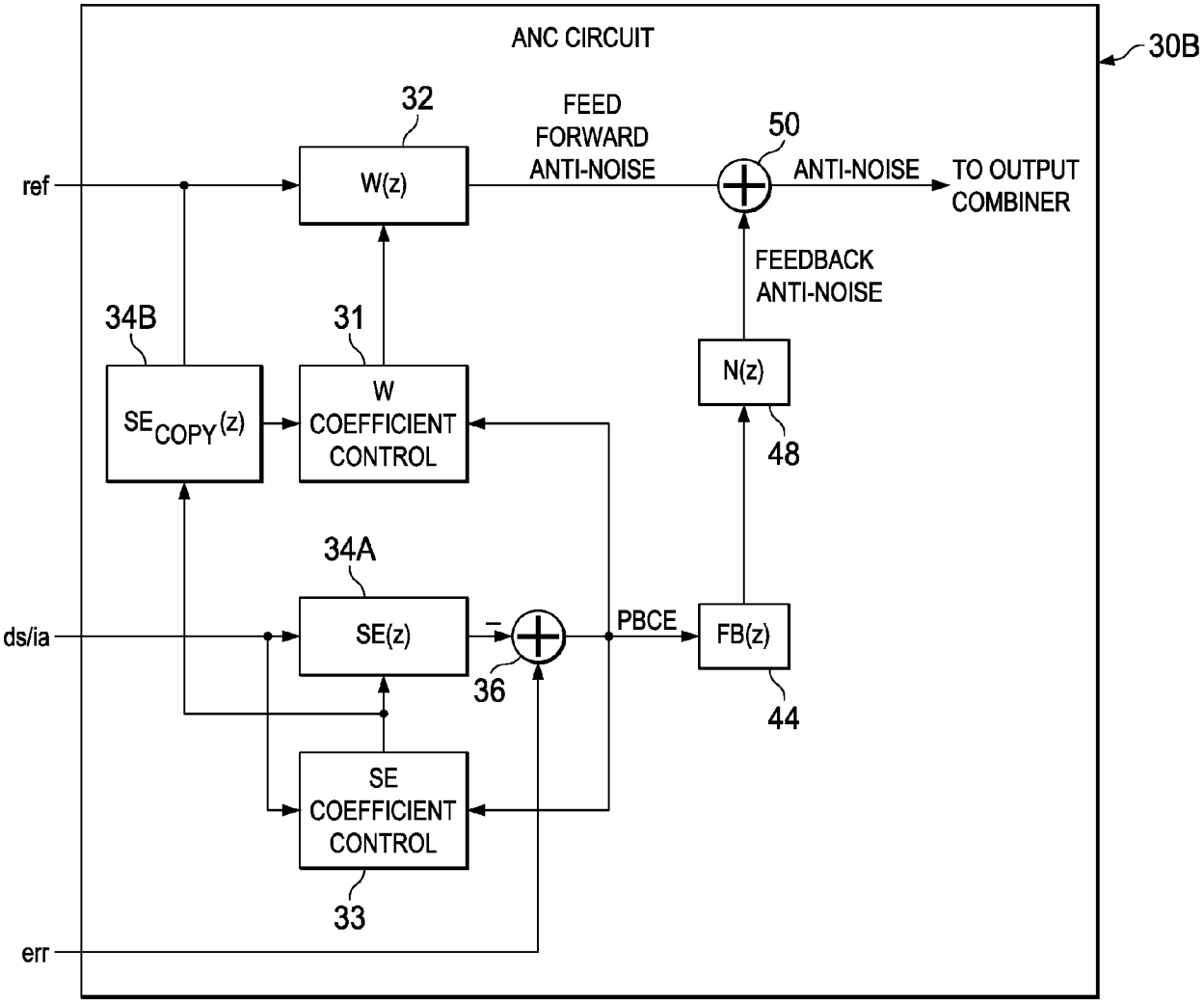
FIG. 3B is a block diagram depicting selected signal processing circuits and functional blocks within another example adaptive noise cancelling (ANC) circuit of a coder-decoder (CODEC) integrated circuit of FIG. 2 which uses feedforward filtering to generate an anti-noise signal, in accordance with embodiments of the present disclosure.

Referring now to FIG. 3B, details of ANC circuit 30B which may be used to implement ANC circuit 30 are shown in accordance with embodiments of the present disclosure. ANC circuit 30B has many components in common with that of ANC circuit 30A. Accordingly, only the differences between ANC circuit 30B and ANC circuit 30A are described in detail. As shown in FIG. 3B, ANC circuit 30B may include a notch filter 48 in series with feedback filter 44 such that the product of response FB(z) and the response N(z) of notch filter 48 is applied to playback corrected error signal PBCE in order to generate the feedback anti-noise component of the anti-noise signal. The feedback anti-noise component of the anti-noise signal may be combined by combiner 50 with the feedforward anti-noise component of the anti-noise signal to generate the anti-noise signal which in turn may be provided to an output combiner that combines the anti-noise signal with the source audio signal to be reproduced by the transducer, as exemplified by combiner 26 of FIG. 2.

Response N(z) of notch filter 48 may effectively reduce a gain of the feedback path comprising feedback filter 44 at particular frequencies (e.g., higher frequencies in the range of 1000 Hz to 8000 Hz) while not affecting noise cancelling performance of the feedback path at other frequencies (e.g., lower frequencies in the range of 50 Hz to 1000 Hz). Accordingly, notch filter 48 may reduce or eliminate instabilities of the feedback loop of ANC circuit 30B that may occur at particular frequencies.

Figure 7:
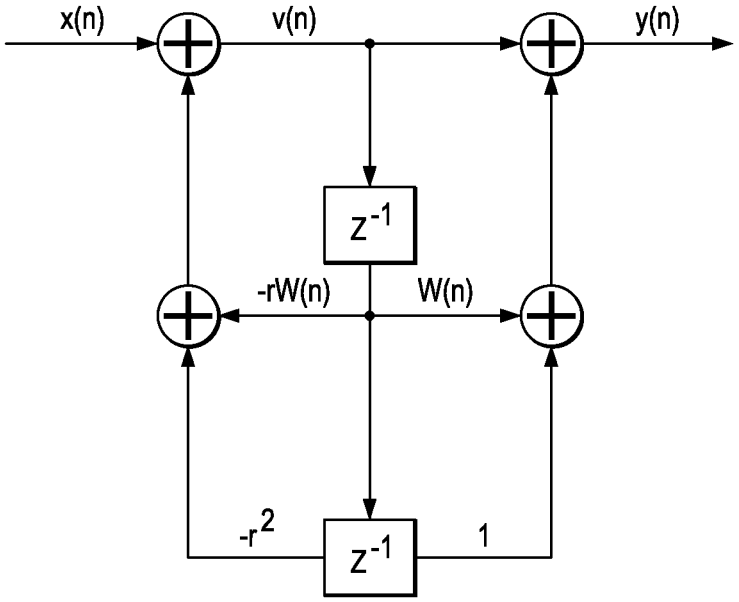
FIG. 7 is a block diagram of an example filter structure that may be used to implement a response of a notch filter, in accordance with embodiments of the present disclosure.

In some embodiments, response N(z) of notch filter 48 may be adaptive. For example, FIG. 7 illustrates a block diagram of an example filter structure that may be used to implement response N(z), in accordance with embodiments of the present disclosure. In FIG. 7, the variable r is a parameter of notch filter 48 which controls the bandwidth of a frequency notch of notch filter 48. The parameter r may be predetermined according to the principle that response N(z) can efficiently cancel an undesired disturbance (e.g., howling) and not affect noise cancellation performance. The parameter μ is a step size of adaptive notch filter 48. The function W(n) may define one or more adaptive coefficients of notch filter 48 which determines the bandwidth of notch filter 48. The function x(n) may comprise an input of notch filter 48 while function y(n) may comprise an output of notch filter 48. The function v(n) may comprise an internal signal in the notch filter structure depicted in FIG. 7.

In the structure shown in FIG. 7, response N(z) may be given by the equation:

$$N(z,n)=(1+w(n)z^{-1}+z^{-2})/(1+rW(n)z^{-1}+r^2z^{-2})$$

where:

$$W(n+1)=W(n)-\mu v(n-1)y(n)$$

Figure 3C:
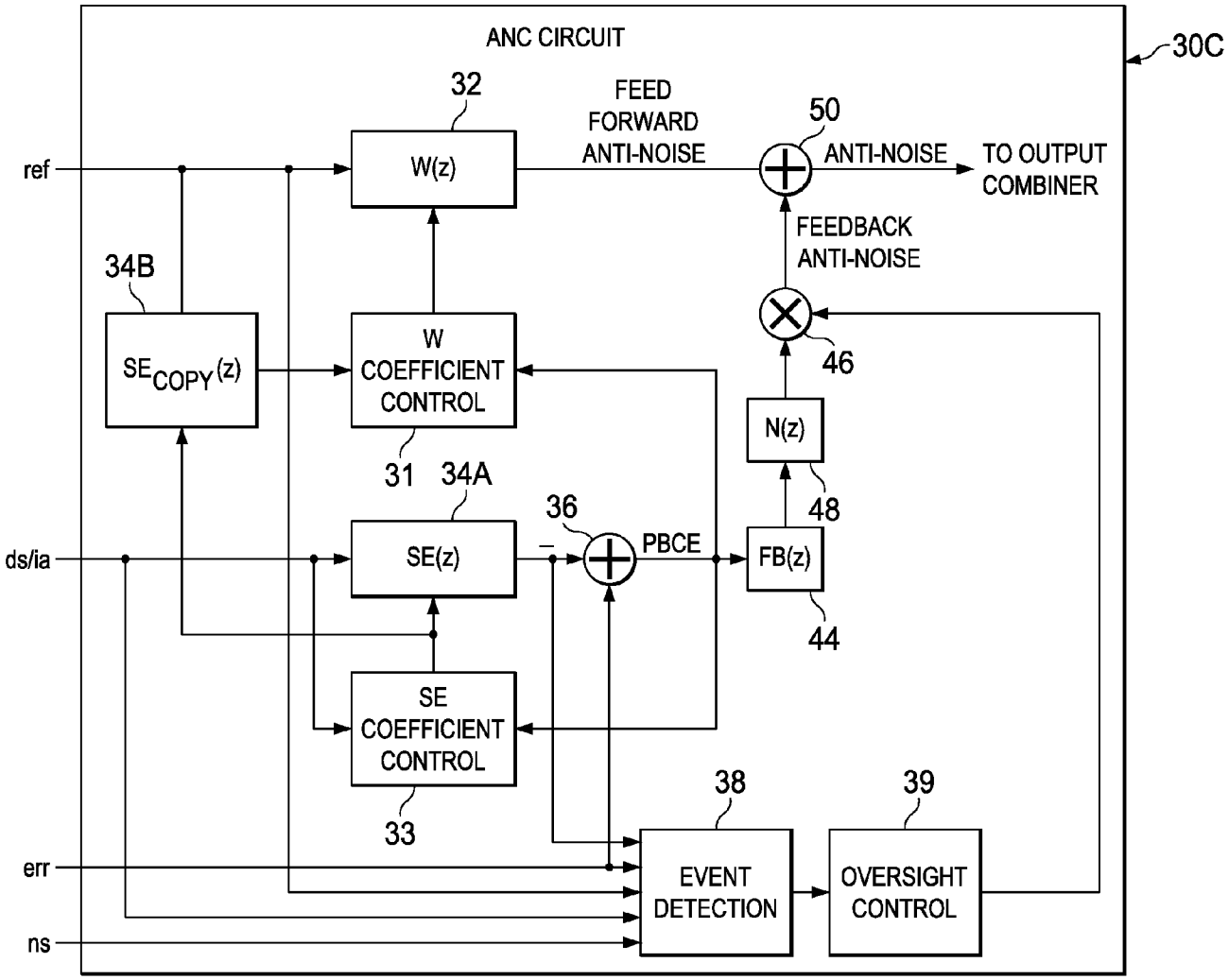
FIG. 3C is a block diagram depicting selected signal processing circuits and functional blocks within another example adaptive noise cancelling (ANC) circuit of a coder-decoder (CODEC) integrated circuit of FIG. 2 which uses feedforward filtering to generate an anti-noise signal, in accordance with embodiments of the present disclosure.

Referring now to FIG. 3C, details of ANC circuit 30C which may be used to implement ANC circuit 30 are shown in accordance with embodiments of the present disclosure. As shown in FIG. 3C, ANC circuit 30C may include a notch filter 48 (e.g., similar or identical to that of ANC circuit 30B) and a programmable gain element 46 (e.g., similar or identical to that of ANC circuit 30A) both in series with feedback filter 44 such that the product of response FB(z), the response N(z) of notch filter 48, and a gain of programmable gain element 46 is applied to playback corrected error signal PBCE in order to generate the feedback anti-noise component of the anti-noise signal. The feedback anti-noise component of the anti-noise signal may be combined by combiner 50 with the feedforward anti-noise component of the anti-noise signal to generate the anti-noise signal which in turn may be provided to an output combiner that combines the anti-noise signal with the source audio signal to be reproduced by the transducer, as exemplified by combiner 26 of FIG. 2.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. An integrated circuit for implementing at least a portion of a personal audio device, comprising:

an output for providing an output signal to a transducer including both a source audio signal for playback to a listener and an anti-noise signal for countering an effect of ambient audio sounds at an acoustic output of the transducer;

an error microphone input for receiving an error microphone signal indicative of the acoustic output of the transducer and the ambient audio sounds at the acoustic output of the transducer;

a reference microphone input for receiving a reference microphone signal indicative of the ambient audio sounds; and a processing circuit that implements:

a secondary path estimate filter configured to model an electro-acoustic path of the source audio signal and have a response that generates a secondary path estimate from the source audio signal; and a secondary path estimate coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate;

a feedback path comprising:

a feedback filter having a response that generates at least a portion of the anti-noise signal based on the error microphone signal; and a variable gain element in series with the feedback filter; and an event detection and oversight control that detects that an ambient audio event is occurring that could cause the feedback filter to generate an undesirable component in the anti-noise signal and controls a gain of the variable gain element to reduce the undesirable component, wherein the ambient audio event comprises a change in a noise boost of the integrated circuit, further wherein the noise boost is based on a difference between a magnitude of the playback corrected error and a magnitude of the reference microphone signal.

2. The integrated circuit of claim 1, wherein the processing circuit further implements an adaptive notch filter in the feedback path in series with the feedback filter in order to reduce the response of the feedback filter in certain frequency ranges.

3. The integrated circuit of claim 1, wherein the ambient audio event comprises a change in the response of the secondary path estimate filter.

4. The integrated circuit of claim 1, wherein the event detection and oversight control controls the gain of the variable gain element such that the gain of the variable gain element is increased when a gain of the response of the secondary path estimate filter decreases and is decreased when the gain of the response of the secondary path estimate filter increases.

5. The integrated circuit of claim 1, wherein the event detection and oversight control controls the gain of the variable gain element such that the gain of the variable gain element is increased when the noise boost decreases and is decreased when the noise boost increases.

6. The integrated circuit of claim 1, wherein the ambient audio event comprises a signal due to positive feedback through a reference microphone due to alteration of coupling between the transducer and the reference microphone.

7. The integrated circuit of claim 6, wherein the event detection and oversight control attenuates the gain of the variable gain element until the signal due to positive feedback is eliminated.

8. The integrated circuit of claim 1, wherein the ambient audio event comprises a signal due to positive feedback through an error microphone due to alteration of coupling between the transducer and the error microphone.

9. The integrated circuit of claim 8, wherein the event detection and oversight control attenuates the gain of the variable gain element until the signal due to positive feedback is eliminated.

10. A method for cancelling ambient audio sounds in a proximity of a transducer, comprising:

receiving an error microphone signal indicative of an output of the transducer and the ambient audio sounds in the proximity of the transducer;

generating a secondary path estimate from a source audio signal by filtering the source audio signal with a secondary path estimate filter modeling an electro-acoustic path of the source audio signal;

adapting the secondary path estimate filter to minimize a playback corrected error, wherein the playback corrected error is based on a difference between the error microphone signal and the secondary path estimate;

receiving a reference microphone signal indicative of the ambient audio sounds;

generating an anti-noise signal for countering effects of the ambient audio sounds in the proximity of the transducer, wherein generating the anti-noise signal comprises:

applying a feedback filter having a response that generates at least a portion of the anti-noise signal based on the error microphone signal; and applying a variable gain element in series with the feedback filter;

monitoring whether an ambient audio event is occurring that could cause the feedback filter to generate an undesirable component in the anti-noise signal and controlling a gain of the variable gain element to reduce the undesirable component, wherein the ambient audio event comprises a change in a noise boost of an integrated circuit, further wherein the noise boost is based on a difference between a magnitude of the playback corrected error and a magnitude of the reference microphone signal; and combining the anti-noise signal with the source audio signal to generate an audio signal provided to the transducer.

11. The method of claim 10, further comprising applying an adaptive notch filter in series with the feedback filter in order to reduce the response of the feedback filter in certain frequency ranges.

12. The method of claim 10, wherein the ambient audio event comprises a change in a response of the secondary path estimate filter.

13. The method of claim 10, further comprising increasing the gain of the variable gain element when a gain of a response of the secondary path estimate filter decreases and decreasing the gain of the variable gain element when the gain of the response of the secondary path estimate filter increases.

14. The method of claim 10, further comprising controlling the gain of the variable gain element such that the gain of the variable gain element is increased when the noise boost decreases and is decreased when the noise boost increases.

15. The method of claim 10, wherein the ambient audio event comprises a signal due to positive feedback through a reference microphone due to alteration of coupling between the transducer and the reference microphone.

16. The method of claim 15, further comprising attenuating the gain of the variable gain element until the signal due to positive feedback is eliminated.

17. The method of claim 10, wherein the ambient audio event comprises a signal due to positive feedback through an error microphone due to alteration of coupling between the transducer and the error microphone.

18. The method of claim 17, further comprising attenuating the gain of the variable gain element until the signal due to positive feedback is eliminated.

* * * * *